US009192218B1

(12) United States Patent
Kaidi et al.

(10) Patent No.: US 9,192,218 B1
(45) Date of Patent: Nov. 24, 2015

(54) NAIL CLIPPER WITH OPPOSING PARALLEL BLADES

(76) Inventors: Alexandre Rachid Kaidi, San Rafael, CA (US); Hamid Reza Shamsapour, San Rafael, CA (US); Risto Aadolf Rinne, Jr., Nicasio, CA (US)

( * ) Notice: Subject to any disclaimer, the term of this patent is extended or adjusted under 35 U.S.C. 154(b) by 296 days.

(21) Appl. No.: 13/385,701

(22) Filed: Mar. 1, 2012

Related U.S. Application Data

(63) Continuation-in-part of application No. 11/305,561, filed on Dec. 15, 2005, now Pat. No. 8,984,754, and a continuation-in-part of application No. 12/658,455, filed on Feb. 4, 2010, now Pat. No. 8,683,700, and a continuation-in-part of application No. 11/226,811, filed on Sep. 13, 2005, now Pat. No. 7,222,427.

(51) Int. Cl.
*A45D 29/00* (2006.01)
*A45D 29/02* (2006.01)

(52) U.S. Cl.
CPC ..... *A45D 29/02* (2013.01)

(58) Field of Classification Search
CPC .. A45D 29/02; A45D 29/2029; A45D 29/026
USPC ..... 30/26–29, 175
See application file for complete search history.

(56) References Cited

U.S. PATENT DOCUMENTS

| | | | | |
|---|---|---|---|---|
| 3,832,771 | A * | 9/1974 | Morgan | 30/28 |
| 5,711,075 | A * | 1/1998 | Wolf | 30/28 |
| 5,964,033 | A * | 10/1999 | Wolf | 30/28 |
| 6,606,794 | B2 * | 8/2003 | Rieser | 30/28 |
| 6,941,657 | B2 * | 9/2005 | Choi et al. | 30/28 |
| 7,007,387 | B2 * | 3/2006 | Kuzuu | 30/28 |
| 7,020,964 | B2 * | 4/2006 | Han et al. | 30/28 |
| 7,062,855 | B2 * | 6/2006 | Merheje | 30/28 |
| 7,194,806 | B2 * | 3/2007 | Kuzuu | 30/28 |
| 7,234,238 | B2 * | 6/2007 | Wong | 30/28 |
| 8,096,053 | B2 * | 1/2012 | Wong | 30/28 |
| 8,640,319 | B2 * | 2/2014 | McMullen, Jr. | 29/428 |
| 2004/0148779 | A1 * | 8/2004 | Choi et al. | 30/28 |
| 2006/0143923 | A1 * | 7/2006 | Blair et al. | 30/28 |
| 2008/0301946 | A1 * | 12/2008 | Baek | 30/28 |
| 2009/0211098 | A1 * | 8/2009 | Childs, II | 30/28 |

* cited by examiner

*Primary Examiner* — Omar Flores Sanchez
(74) *Attorney, Agent, or Firm* — Risto A. Rinne, Jr.

(57) ABSTRACT

An apparatus for cutting nails includes a plastic frame with a pair of opposing parallel cutting blades. A first of the pair of blades is attached to an upper half of the frame and a second of the pair of blades is attached to a lower half of the frame. The blades are formed of a material that is different than the frame. A center rod extends through the frame and the cutting blades. The center rod is used to create and transfer a force necessary to sever a fingernail or toenail and to secure a position of the blades with respect to each other. A pivoting lever is used to supply the force to a surface of the blades sufficient to urge the cutting blades toward each other to simultaneously sever the nail. The majority of the forces produced during use are applied directly to the cutting blades.

19 Claims, 5 Drawing Sheets

NAIL CLIPPER WITH OPPOSING PARALLEL BLADES

This application is a continuation-in-part of patent application Ser. No. 11/305,561 that was filed on Dec. 15, 2005, and of patent application Ser. No. 12/658,455 that was filed on Feb. 4, 2010, and of patent application Ser. No. 11/226,811 filed Sep. 13, 2005, now U.S. Pat. No. 7,222,427 entitled "Nail Clipper," and which claims the benefit of priority, thereof.

RESERVATION OF RIGHTS

A portion of the disclosure of this patent document contains material which is subject to intellectual property rights such as but not limited to copyright, trademark, and/or trade dress protection. The owners have no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention, in general, relates to personal grooming devices and, more particularly, to toe and finger nail clippers.

Nail clippers, the term as used herein including either toe or finger nail type of clippers, are generally well known.

Certain prior art types of nail clippers do not fold sufficiently flat for storage. Others do not apply leverage that can create sufficient force to cut through difficult nails without requiring a great deal of force by a user.

Prior art nail clippers include a considerable amount of metal that has been machined, or stamped or otherwise formed and assembled together. This is considerably more expensive than plastic, for example. However, all prior art designs that have opposing parallel cutting blades which provide simultaneous cutting of the top and bottom of the nail have heretofore included a metallic nail clipper, with perhaps plastic surrounding certain components. This is because the mechanical stresses arising during use have precluded the use of a plastic body in the type of nail clipper that has opposing parallel cutting blades. It is also expensive to manufacture such prior art types of nail clippers due to the amount of metal that must be used.

The prior art opposing parallel blade nail clippers include a center post that engages with a pivoting lever, both of which are generally made from metal. A main body of the prior art nail clipper is also made from metal. The pivoting lever, pressing upon a ridge in the center post applies pressure to the clipper sufficient to urge a pair of opposite sides, and therefore also the opposing parallel blades, toward one-another during use.

There is a need for a nail clipper that is inexpensive to manufacture. There is a need for a disposable nail clipper that is also inexpensive to manufacture. A sufficiently inexpensive nail clipper could include an advertising and be given away or at offered at finer hotels or even sold for minimum cost, for example. There is need for a nail clipper that can meet any of these needs and which also has opposing parallel cutting blades.

Certain nail salon patrons may experience reluctance in using nail clippers that have been used on other nail salon patrons. At times, it is difficult to determine if proper sanitation procedures have been properly followed before the nail clipper is used on the next nail patron. The inexpensive nail clipper may be given to the nail salon patron for their own personal use while they are at the nail salon and then may be taken home for later use. That way the nail salon patron can be assured that the nail clipper that is used to cut their nails is sanitary.

Nail clippers are expensive because of the machining that is required to manufacture and assemble together the upper and lower metal portions, thereof. The top and bottom blades must not only be ground to a fine edge, but the cutting edges must align precisely. It is relatively inexpensive to make a blade, but the manufacturing of two blades with opposing parallel cutting edges that mesh precisely together drives up the cost of the nail clipper.

Also, because nail clippers include so much metal, they are detected at airport security checks and often result in the searching of personal sundries that would not otherwise be so scrutinized. They may even be confiscated as a potentially dangerous weapon, which of course is a debatable assessment, but if confiscated it leaves the person without a nail clipper when they reach their destination. It is desirable to include sufficiently little metal with a nail clipper so that it does not generally register as a potential threat during airport security procedures.

Scissor-types of nail clippers with a plastic body and metal cutting blades are known, but are substantially different than nail clippers with opposing parallel blades that simultaneously cut both sides of the nail along the entire longitudinal length of the blades. The scissor-type of nail clipper is always severing the nail at a point, not along a line. Therefore, the scissor-type of nail clipper experiences only the smallest fraction of mechanical stress that is experienced by nail clippers with opposing parallel blades. However, scissor-types of nail clippers have many disadvantages. They increase the risk of cutting the finger of a user and are difficult to control. They also require more time to cut each nail than opposing parallel blade nail clippers.

Accordingly, there exists today a need for a nail clipper with opposing parallel blades that helps to ameliorate the above-mentioned problems and difficulties as well as ameliorate those additional problems and difficulties as may be recited in the "OBJECTS AND SUMMARY OF THE INVENTION" or discussed elsewhere in the specification or which may otherwise exist or occur and that are not specifically mentioned herein.

As various embodiments of the instant invention help provide a more elegant solution to the various problems and difficulties as mentioned herein, or which may otherwise exist or occur and are not specifically mentioned herein, and by a showing that a similar benefit is not available by mere reliance upon the teachings of relevant prior art, the instant invention attests to its novelty. Therefore, by helping to provide a more elegant solution to various needs, some of which may be long-standing in nature, the instant invention further attests that the elements thereof, in combination as claimed, cannot be obvious in light of the teachings of the prior art to a person of ordinary skill and creativity.

Clearly, such an apparatus would be useful and desirable.

2. Description of Prior Art

Nail clippers are, in general, known. For example, the following patent documents describe various types of these devices, some of which may have some degree of relevance to the invention. Other patent documents listed below may not have any significant relevance to the invention. The inclusion of these patent documents is not an admission that their teachings anticipate any aspect of the invention. Rather, their inclusion is intended to present a broad and diversified understanding regarding the current state of the art appertaining to either the field of the invention or possibly to other related or even distal fields of invention.

U.S. Pat. No. 7,024,774 to Novellie, et al., that issued on Apr. 11, 2006;

U.S. Pat. No. 7,020,964 to Han, et al., that issued on Apr. 4, 2006;

U.S. Pat. No. 6,941,657 to Choi, et al., that issued on Sep. 13, 2005;

U.S. Pat. No. 6,606,794 to Rieser, that issued on Aug. 19, 2003;

U.S. Pat. No. 6,088,919 to Gilman, that issued on Jul. 18, 2000;

U.S. Pat. No. 5,983,498 to Lieberman, et al., that issued on Nov. 16, 1999;

U.S. Pat. No. 5,964,033 to Wolf, that issued on Oct. 12, 1999;

U.S. Pat. No. 5,634,275 to Pine, that issued on Jun. 3, 1997;

U.S. Pat. No. 5,488,772 to Dababneh, et al., that issued on Feb. 6, 1996;

U.S. Pat. No. 5,331,739 to Basangy, that issued on Jul. 26, 1994;

U.S. Pat. No. 5,195,544 to Campagna, that issued on Mar. 23, 1993;

U.S. Pat. No. 4,847,994 to Dunn, Jr., that issued on Jul. 18, 1989;

U.S. Pat. No. 4,819,673 to McMullen, Jr., that issued on Apr. 11, 1989;

U.S. Pat. No. 4,776,090 to Grassi, that issued on Oct. 11, 1988;

U.S. Pat. No. 4,731,927 to Wilson, that issued on Mar. 22, 1988;

U.S. Pat. No. 4,614,031 to Chen, that issued on Sep. 30, 1986;

U.S. Pat. No. 4,550,496 to Reinicke, that issued on Nov. 5, 1985;

U.S. Pat. No. 4,519,134 to Bumbera, that issued on May 28, 1985;

U.S. Pat. No. 4,341,015 to Young, that issued on Jul. 27, 1982;

U.S. Pat. No. 4,130,937 to Kim, that issued on Dec. 26, 1978;

U.S. Pat. No. 3,997,966 to Sartore, that issued on Dec. 21, 1976;

U.S. Pat. No. 3,914,866 to Applegate, that issued on Oct. 28, 1975; and

U.S. Pat. No. 796,389 to Wright, that issued on August 1905.

And including U.S. Patent Application Publications:

U.S. Patent Application Publication No. 2009/0211098 to Childs, II, that published on Aug. 27, 2009;

U.S. Patent Application Publication No. 2004/0098861 to Novellie, et al., that published on May 27, 2004; and U.S. Patent Application Publication No. 2004/0148779 to Choi, et al., that published on Aug. 5, 2004.

While the structural arrangements of the above described devices may, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a nail clipper with opposing parallel blades that is inexpensive to manufacture.

It is also an important object of the invention to provide a nail clipper with opposing parallel blades that is sufficiently inexpensive to manufacture and which may be disposable.

Another object of the invention is to provide a nail clipper with opposing parallel blades that may include a straight cutting edge.

Still another object of the invention is to provide a nail clipper with opposing parallel blades that may include a curved cutting edge.

Still yet another object of the invention is to provide a nail clipper with opposing parallel blades that includes a body that is primarily made of a plastic, nylon, or polymer.

Yet another important object of the invention is to provide a nail clipper with opposing parallel blades that includes an upper and a lower blade that are attached to a plastic frame.

Still yet another important object of the invention is to provide a nail clipper with opposing parallel blades that includes a plastic frame that is attractive.

A first continuing object of the invention is to provide a nail clipper with opposing parallel blades that includes a plastic frame that includes advertising.

A second continuing object of the invention is to provide a nail clipper with opposing parallel blades that includes a plastic frame that is available in a desired color.

A third continuing object of the invention is to provide a nail clipper with opposing parallel blades that is aesthetically attractive.

A fourth continuing object of the invention is to provide a nail clipper with opposing parallel blades that is lightweight.

A fifth continuing object of the invention is to provide a nail clipper with opposing parallel blades that includes a first blade portion that is formed of a metallic or other suitable material and a second blade portion that is formed of a metallic or other suitable material and wherein a remainder of the nail clipper is not formed of the same material as are the first and the second blade portions.

A sixth continuing object of the invention is to provide a nail clipper with opposing parallel blades that includes a first blade portion and a second blade portion that absorb mechanical stresses that occur during use.

A seventh continuing object of the invention is to provide a nail clipper with opposing parallel blades that includes a first blade portion and a second blade portion that, when a downward force is applied by a pivoting lever, the first blade portion and the second blade portion are urged toward one another to provide a means for simultaneously cutting an upper and a lower portion of a fingernail or a toenail.

Briefly, a nail clipper with opposing parallel blades that is constructed in accordance with the principles of the present invention has a main body consisting of a plastic frame. The plastic frame, according to one embodiment, resembles an elongated "U-shape" in appearance. If desired, the plastic frame may be made of another material such as nylon or polymer or it may include a generally "V-shape". The frame includes a pair of cutting blades that are placed over a pair of end portions of the frame. The pair of cutting blades includes a first blade portion and a second blade portion. The first blade portion and the second blade portion are preferably made from steel and are included at the end portions of the frame. The first and the second blade portions are attached to the end portions of the frame by friction or by any other preferred means. If desired, a recess may be provided on the end portions of the frame. A protrusion may also be included on each of the first and the second blade portions or the locations of the recess and the protrusion may be reversed. The protrusion on each of the first and the second blade portions cooperatively engage with each of the recesses on the end portions of the frame to secure the first and the second blade portions onto the frame. A center rod extends vertically through the first blade portion, through a first of the pair of end portions of the frame, through a second of the pair of end portions of the frame, and through the second blade portion. A pair of rivet-like ends, machine screws, or other means hold the center rod in position and secure each end of the center rod proximate the first and the second blade portions. The center rod can also be used to secure the first and the second blade portions in the desired position on the end portions of the frame. A pivoting lever is provided that includes a lower portion of the pivoting lever that, during use, the lower portion of the pivoting lever is disposed directly over a top surface of the first blade portion. A lower end of the pivoting lever includes a slight change of angle. The pivoting lever is preferably made from a strong plastic. If desired, the pivoting lever may also be made from steel or any other desired material. The pivoting lever may include any suitable preferred design. The pivoting lever is used to supply a downward force on the top surface of the first blade portion and a simultaneous upward force on a bottom surface of the second (or lower) blade portion. The force applied by the pivoting lever urges the first blade portion and the second blade portion closer together. When urged into a fully closed position, a first cutting edge of the first blade portion is able to contact a second cutting edge of the second blade portion along a longitudinal length of the first and second cutting edges. Together, the first cutting edge and the second cutting edge provide a means for simultaneously cutting a top and a bottom surface of a nail or a toenail that has been placed between the two cutting edges along the longitudinal length of the first and the second cutting edges. Once the downward force is no longer being applied to the pivoting lever, hysteresis of the frame urges the first and the second cutting edges away from one another. If desired, an additional amount of plastic material may be included within the curved portion between a top half and a bottom half of the frame to help urge the first and the second cutting edges apart. The additional plastic material, if included, providesextra support for the frame and to urge the frame in a quiescent spaced-apart open state after cutting has occurred. An alternate modified embodiment of the nail clipper includes a modified plastic frame that includes a straight, rather than a curved, frame design. If desired, a wedge is included between a top and a bottom half of the modified frame distally with respect to the first and second blade portions. The wedge, if included, provides additional structural integrity to the modified frame and an additional force to urge the frame into the open state. The modified frame may include two separate pieces that are fused (i.e., welded) together or the modified frame may be molded together at an end distally disposed with respect to the blades. Alternately, a retaining clip may be included which holds the top half and the bottom half of the modified frame together. A modified pivoting lever is included on a top surface of the first blade portion. The downward force is applied by the modified pivoting lever to the top surface of the first blade portion and to the bottom surface of the second (or lower) blade portion. The first and the second cutting edges of the first and the second blade portions sever the nail which is placed between the two cutting edges. Once the downward force is no longer being applied, the blade portions of the modified nail clipper return to a quiescent spaced-apart open state.

DETAILED DESCRIPTION OF THE INVENTION

Figure 1:
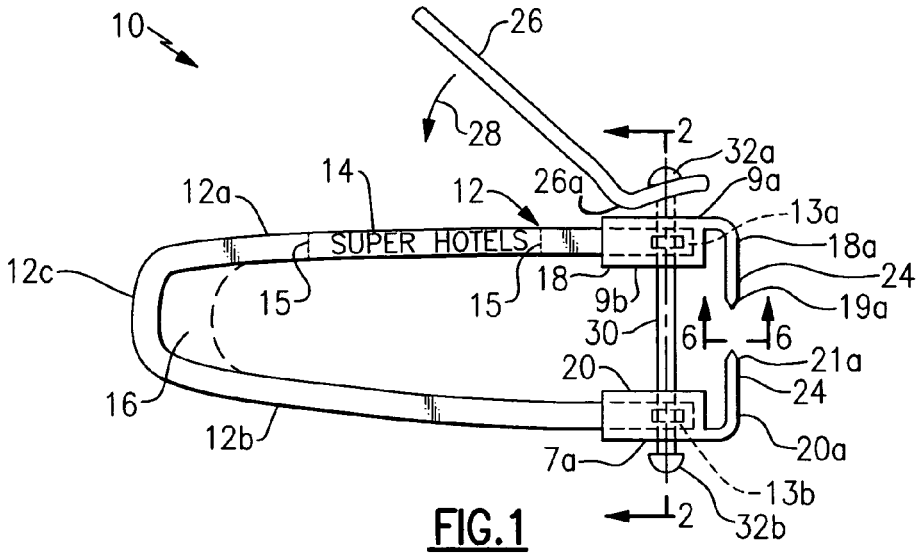
FIG. 1 is a side view of a nail clipper with opposing parallel blades.

Referring on occasion to all of the FIGURE drawings and now, in particular to FIG. 1, is shown a nail clipper with opposing parallel blades, identified in general, by the reference numeral 10. While steel is preferred, any suitable material other than steel may also be used to form the blades, such as ceramic or sufficiently hard composite materials. While the following description refers specifically to steel blades, it is to be understood that other suitable materials may be used for the blades.

The reader will notice that reference is occasionally made throughout the DETAILED DESCRIPTION OF THE INVENTION suggesting that the reader refer to a particular drawing FIGURE. The suggestion is at times made when the introduction of a new element requires the reader to refer to a different drawing FIGURE than the one currently being viewed and also when the timely viewing of another drawing FIGURE is believed to significantly improve ease of reading or enhance understanding. To promote rapid understanding of the instant invention the reader is encouraged to periodically refer to and review each of the drawing FIGURES for possible cross-referencing of component parts and for other potentially useful information.

Certain examples are shown in the above-identified FIGURES and are described in greater detail below. In describing these examples, like or identical reference numerals may be used to identify common or similar elements.

The nail clipper with opposing parallel blades 10 includes a one-piece plastic frame 12 that is molded out of a sufficient grade of plastic, nylon, or other preferred material that is not a metal. The frame 12 resembles an elongated "U-shape" in appearance. It is to be understood that many variations in shape are possible for the frame 12. Additionally, and as described in greater detail hereinafter, it is possible to modify the frame 12 so that it is formed of two or more pieces that are cooperatively secured (or attached) together at a distal end, thereof.

The frame 12 can be any desired color of plastic. For example, a pink color of the frame 12 may appeal to girls and women whereas another color may be more likely to appeal to boys and men.

Figure 9:
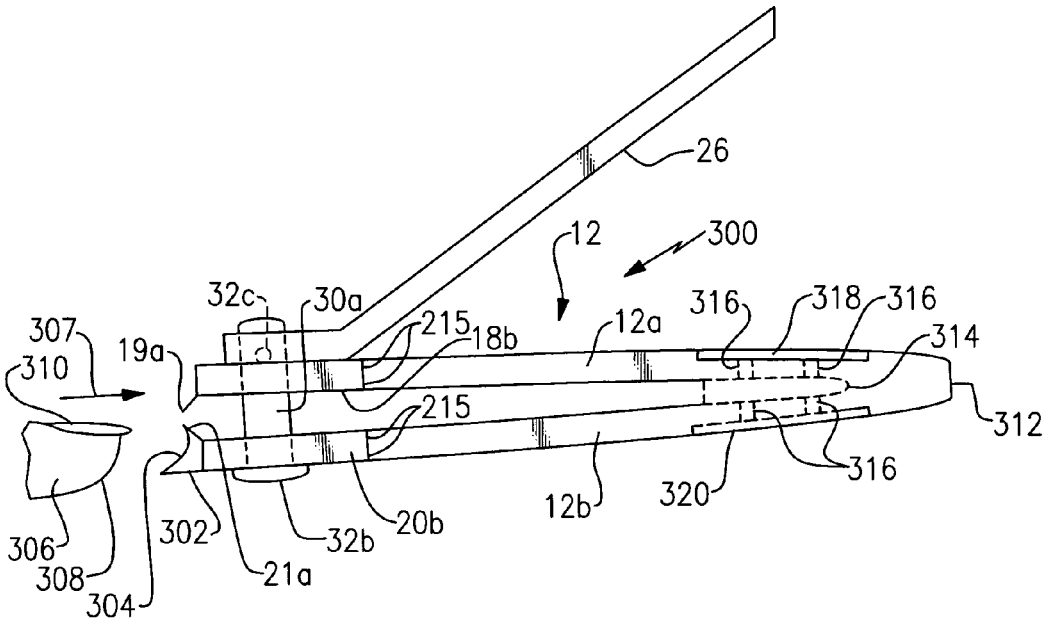
FIG. 9 is a side view of a third modified nail clipper.

If desired, an advertisement 14 is provided wherever preferred on the frame 12. Also if desired, the frame 12 may include sections or portions, thereof, that are formed of different materials. For example, one grade of plastic may be used to form the structural parts of the frame 12 and a different grade of plastic or other type of material, may be included as an insert 15 (within dashed lines) to house the advertisement 14 (i.e., advertising). Refer also to FIG. 9 and the description of FIG. 9 regarding the use of different grades of plastic. In this way, the same overall basic version of the nail clipper with opposing parallel blades 10 can be produced for a wide variety of different purposes as different inserts 15 can be produced for different advertisements 14 to meet the needs of different advertisers. The inserts 15 can be of any desired depth and can also be designed to snap in place, if desired. If desired, the inserts 15 can be disposed on any surface of the frame 12 of the nail clipper with opposing parallel blades 10.

Hotels and other companies of any type who wish to increase customer awareness of their products (or services) can include their name, telephone number, and website as part of the advertisement 14. The nail clipper with opposing parallel blades 10 may also be an amenity that is provided by a hotel.

In addition, the nail clipper with opposing parallel blades 10 may be offered for free (or at a small cost) at a nail salon.

Every time a person who has received one of the nail clipper with opposing parallel blades 10 for free cuts his or her nails, they are apt to be reminded of the company (i.e., hotel, nail salon, etc.) that provided the nail clipper with opposing parallel blades 10. If repeated enough times, when a purchase decision is required by the person for a product or service offered by the company, it is likely that the name of the company will spring favorably to mind.

The frame 12 includes an upper half 12*a* and a lower half 12*b*. If desired, a greater amount of plastic or any other (elastomeric) material 16 (shown in dashed lines) may be included or added as an insert near a rear portion 12*c* of the frame 12. The plastic or other material 16 is used to urge the lower half 12*b* away from the upper half 12*a* back into a quiescent spaced-apart open state.

The upper half 12*a* of the frame 12 includes a first blade portion 18. The lower half 12*b* of the frame 12 includes a second blade portion 20. The first and the second blade portions 18, 20 are preferably formed of steel, although other materials, for example a ceramic material, or any other suitable composite or other material can be used to form the first and the second blade portions 18, 20, as desired.

As there is little metal (i.e., steel) used for the first and the second blade portions 18, 20 an unexpected benefit is provided. Airport security devices are not likely to detect the nail clipper with opposing parallel blades 10 during security screening. This prevents delays and possible confiscation of the nail clipper with opposing parallel blades 10 by overly zealous airport security personnel.

The first blade portion 18 is urged over a first end 13*a* of the upper half 12*a* of the frame 12. The second blade portion 20 is urged over a second end 13*b* of the lower half 12*b* of the frame 12. Both of the first and the second blade portions 18, 20 are preferably held in place by friction although other means, such as the use of an adhesive may be used. If desired, the first and the second blade portions 18, 20 can be crimped to secure the first and the second blade portions 18, 20 in place during insertion onto the frame 12. Further means for securing the first and the second blade portions 18, 20 to the frame 12 are described in greater detail, hereinafter.

The first blade portion 18 includes a small piece of planar material that includes a first cutting member 18*a* that extends downward from a top planar surface 9*a* of the first blade portion 18, as shown in FIG. 1. If preferred, the first cutting member 18*a* could be modified to extend outward and downward from a bottom planar surface 9*b* of the first blade portion 18. See FIG. 8 and FIG. 9 for other examples extending outward and downward.

The first cutting member 18*a* includes a first cutting edge 19*a*. The first cutting member 18*a* includes a planar portion that extends outward from the top planar surface 9*a* of the first blade portion 18 and then bends downward to include approximately a ninety-degree radius. A radius that is less than or greater that ninety-degrees is also possible. A remainder of the first cutting member 18*a* extends in a downward direction with the first cutting edge 19*a* disposed at a bottom end of the first cutting member 18*a*.

The second blade portion 20 also includes a small piece of planar material that includes a second cutting member 20*a* that extends upward from the second blade portion 20, and is disposed closest toward the top or upper half 12*a* of the frame 12. The second cutting member 20*a* is identical to the first cutting member 18*a*, just oriented upside down with respect thereto. Therefore, the first and the second blade portions 18, 20 are preferably identical, just inverted. This helps to decrease manufacturing costs.

The second cutting member 20*a* includes a second cutting edge 21*a*. The second cutting member 20*a* includes a planar portion that extends outward from a bottom planar surface 7*a* of the second blade portion 20 and then bends to include approximately a ninety-degree radius. As long as the first cutting edge 19*a* and the second cutting edge 21*a* abut each other when the nail clipper with opposing parallel blades 10 is disposed in the fully closed position, any desired radius for the bend is possible. A remainder of the second cutting member 20*a* extends in a upward direction with the second cutting edge 21*a* parallel with the first cutting edge 19*a* of the first cutting member 18*a*.

As described in greater detail, hereinafter, the first and the second cutting members 18*a*, 20*a* can be straight or curved, but the first cutting edge 19*a* and the second cutting edge 21*a* are always on the same plane so that when urged together they abut each other along their respective longitudinal lengths. The first and the second cutting members 18*a*, 20*a* are ground or otherwise formed into the first and second cutting edges 19*a*, 21*a*. The first and the second cutting members 18*a*, 20*a* preferably include opposing tapered surfaces, as shown, that terminate at a center to form the first and second cutting edges. Alternately, the first and second cutting edges 19*a*, 21*a* may be disposed at an interior or at an exterior of the first or the second cutting members 18*a*, 20*a* with only one tapered surface extending to the opposite side. Accordingly, the first and second cutting edges 19*a*, 21*a* may align with a center longitudinal axis of the first and second cutting members 18*a*, 20*a* or they may align with an interior or exterior edge of the first and second cutting members 18*a*, 20*a*.

As mentioned previously, the first and the second blade portions 18, 20 are preferably made from steel. As the first and the second cutting members 18*a*, 20*a* are extensions of the first and the second blade portions 18, 20 they too are also preferably formed of steel, although other materials, such as a ceramic or other suitable material can be used, if desired.

The nail clipper with opposing parallel blades 10 is considerably less expensive to manufacture than a prior art opposing parallel steel blade type of nail clipper (not shown) for several reasons. First, the steel that is used to form the body of the prior art type of nail clipper is eliminated by the nail clipper with opposing parallel blades 10. Second, the first and the second blade portions 18, 20 use very little steel and can be stamped out of sheet stock with the cutting edges 19*a*, 21*a* easily ground on a distal edge of the first and second cutting members 18*a*, 20*a* and then bent to include the desired radius. Third, by ensuring that the overall length of the upper and the lower halves 12*a*, 12*b* are the same, such as by precision molding techniques or by grinding (i.e., removing) excess material off the ends 13*a*, 13*b* and by controlling the amount (depth) the first and the second blade portions 18, 20 are inserted over the ends 13*a*, 13*b* of the upper and the lower halves 12*a*, 12*b*, it is easy to ensure that the cutting edges 19*a*, 21*a* will align and abut each other when the nail clipper with opposing parallel blades 10 is urged into a closed position.

Figure 5:
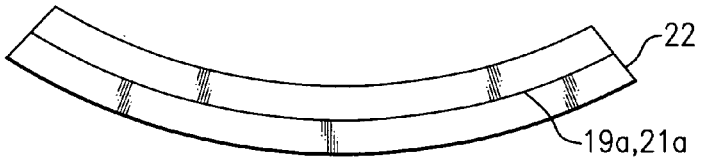
FIG. 5 is a view taken along line 5-5 of a curved cutting edge of a first blade portion of FIG. 3 looking up from underneath the first blade portion.
Figure 6:
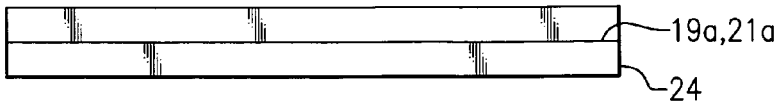
FIG. 6 is a view taken along line 6-6 of a straight cutting edge of the first blade portion of FIG. 1 looking up from underneath the first blade portion.

Referring briefly to FIGS. 5 and 6, are shown two different types of cutting edges that may be included with the nail clipper with opposing parallel blades 10 or any modified version, thereof.

Figure 3:
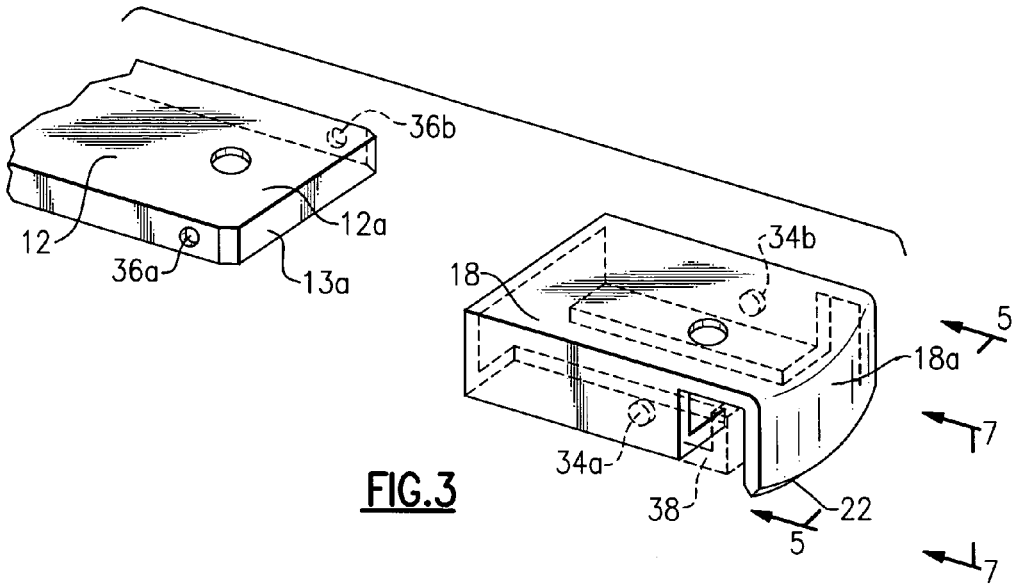
FIG. 3 is an exploded view in perspective of a first blade portion and an upper portion of a main body of the nail clipper with opposing parallel blades of FIG. 1 except that a modified curved cutting edge is shown in FIG. 3 in place of a straight cutting edge as shown in FIG. 1.

FIG. 5 is a view taken along line 5-5 of FIG. 3 and it shows a possible curved cutting edge 22 that can be included with the first cutting edge 19*a* and also, of necessity, with the second cutting edge 21*a*, if desired. When urged together, the curved cutting edges 22 of the (slightly modified) first and second blade portions 18, 20 abut each other along their entire longitudinal length. The curved cutting edges 22 of the first and the second blade portions 18, 20 are disposed on the same horizontal plane and are parallel with respect to each other when disposed in the quiescent spaced-apart position and when abutting each other, or anywhere in-between.

The curved cutting edge 22 is used to provide a more rounded cut to a fingernail or toenail (not shown). The rounded cut may appeal to certain users who wish to have their nails correspond with a natural curvature of their fingertips or toes.

Figure 4:
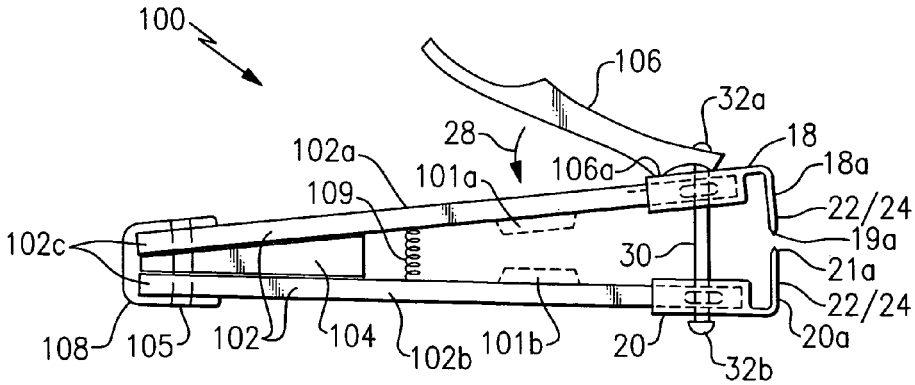
FIG. 4 is a side view of an alternate modified embodiment of the nail clipper with opposing parallel blades of FIG. 1.

FIG. 6 is a view taken along line 6-6 of FIG. 1 and it shows a possible straight cutting edge 24 that is shown for the first cutting edge 19*a* and second cutting edge 21*a* of FIGS. 1 and 4. When urged together, the straight cutting edge 24 of the first and the second cutting edges 19*a*, 21*a* abut each other along their entire longitudinal horizontal length. The straight cutting edges 24 of the first and the second cutting edges 19*a*, 21*a* are disposed on the same plane and are parallel with respect to each other when disposed in the quiescent spaced-apart position and when abutting each other, or anywhere in-between.

The straight cutting edge 24 provides a linear cut across the entire longitudinal length of the fingernail or toenail, which may appeal to users who wish to have their nails cut straight and not rounded. Alternately, a rounded cut can be achieved by the cutting of several shorter straight sections of nail and by filing the intersecting corners.

Now referring back to FIG. 1, a pivoting lever 26 is used to urge the first and the second cutting members 18*a*, 20*a* closer to one another to be able to simultaneously cut the upper and lower surfaces of the finger or the toenail.

The pivoting lever 26 is preferably made from a strong plastic material, or if desired, the pivoting lever 26 may be made from steel or any other preferred material. However, if steel is used, manufacturing costs for the nail clipper with opposing parallel blades 10 will increase.

The pivoting lever 26 is pivotally attached to a center rod 30. The center rod 30 will be described in greater detail, hereinafter. The pivoting lever 26 (and modified pivoting lever 106) are shown in a position for cutting of the fingernail or toenail. It is possible to rotate the pivoting lever 26 in a direction opposite that as shown by arrow 28 and then rotate the pivoting lever 26 about a center longitudinal axis of the center rod 30 to dispose the pivoting lever 26 in a compact position for transport of the nail clipper with opposing parallel blades 10. The same is possible for a modified pivoting lever 106 (see FIG. 4).

A downward force, as shown by arrow 28, is applied to the pivoting lever 26. The downward force 28 urges a lower portion 26*a* of the pivoting lever 26 onto the top planar surface 9*a* of the first blade portion 18.

It is important to note that the lower portion 26*a* of the pivoting lever 26 contacts the top planar surface 9*a* of the first blade portion 18. This provides a significant unexpected benefit. The downward force 28 is only applied to the first blade portion 18. There is no significant stress from the downward force 28 applied to any of the frame 12. The frame 12 merely supplies the structure necessary to maintain the first and the second blade portions 18, 20 in alignment during use. The frame 12 also supplies the force necessary to urge the first and the second blade portions 18, 20 apart when no more force is being applied to the first and second blade portions 18, 20 by urging the pivoting lever 26 in the direction of arrow 28.

This allows the frame 12 to be made from a sufficiently lesser grade of plastic or other material. In addition, the lesser grade of plastic is less expensive to manufacture and, in turn, allows the nail clipper with opposing parallel blades 10 to be manufactured at a lower cost or disposable. As mentioned before, the nail clipper with opposing parallel blades 10 can even be given away for free.

As mentioned previously, the nail clipper with opposing parallel blades 10 may be offered as an amenity to a hotel guest or nail salon patron. Therefore, it is desirable to keep manufacturing costs down in order to provide the nail clipper with opposing parallel blades 10 at little added cost or even at no cost to the hotel guest or nail salon patron.

The upper half 12*a* and the lower half 12*b* of the frame 12 are urged toward each other when a sufficient downward force 28 is applied to overcome resistance from cutting through the nail that is disposed between the first cutting edge 19*a* and the second cutting edge 21*a* during use. See also FIG. 9.

When urged together into the fully closed position, the first cutting edge 19*a* and the second cutting edge 21*a* are parallel, align sufficiently well with respect to each other, and abut each other.

A fingernail or a toenail is inserted between the first and the second cutting edges 19*a*, 21*a* prior to application of the downward force 28 onto the pivoting lever 26. The upper and lower surfaces of the fingernail or the toenail are simultaneously severed when sufficient downward force 28 is applied to the pivoting lever 26 to urge the upper half 12*a* and the lower half 12*b* toward each other and thereby cause the curved cutting edge 22 or the straight cutting edge 24 (whichever is included) to sever the nail.

Typically, a thumb and finger of an opposite hand of a user (not shown) can supply the downward force onto the pivoting lever 26 to sever the nail. As mentioned previously, the downward force is applied to the top planar surface 9*a* of the first blade portion 18. Simultaneously, an upward force is applied to the bottom planar surface 7*a* of the second blade portion 20 by the center rod 30. Accordingly, when the pivoting lever 26 is urged in the direction of arrow 28, a downward force is urging the first blade portion 18 and the upper half 12*a* of the frame 12 downward while a simultaneous upward force is urging the second blade portion 20 and the lower half 12*b* of the frame 12 upward.

Once the downward force is no longer being applied to the top planar surface 9*a* of the first blade portion 18 and the upward force is no longer being applied to the bottom planar surface 7*a* of the second blade portion 20, normal hysteresis of the frame 12 returns the nail clipper with opposing parallel blades 10 to a spaced-apart quiescent open state. The additional plastic material or other material 16, if included, also helps to return the nail clipper with opposing parallel blades 10 to the quiescent spaced-apart open position.

Figure 2:
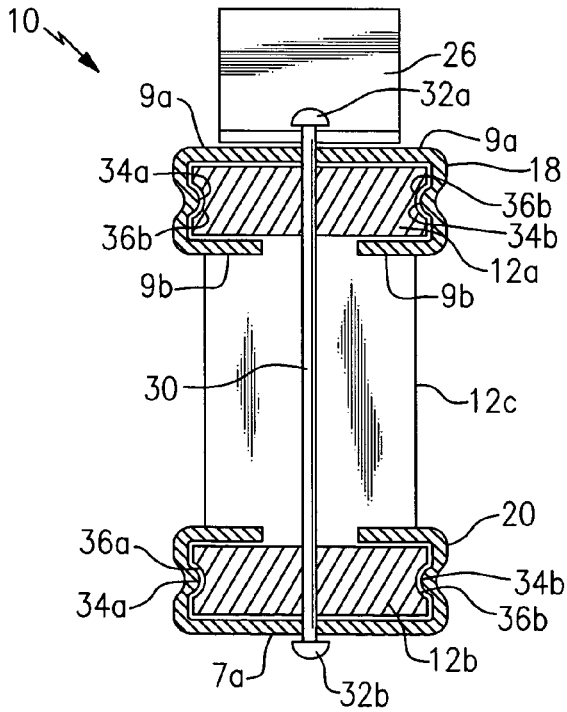
FIG. 2 is a cross-sectional view taken along line 2-2 of the nail clipper with opposing parallel blades of FIG. 1.

Now referring to FIG. 2, is shown a cross-sectional view of the nail clipper with opposing parallel blades 10 taken along line 2-2 of FIG. 1.

The center rod 30 extends vertically through a hole provided in the pivoting lever 26, a hole provided through the first blade portion 18, a hole provided through the first end portion 13*a* of the upper half 12*a* of the frame 12, through a hole provided through the second end portion 13*b* of the lower half 12*b* of the frame 12, and through a hole provided through the second blade portion 20. The center rod 30 is preferably made from steel, however any sufficiently strong material may be used.

A pair of rivet ends 32*a*, 32*b* are provided at opposite ends of the center rod 30 to secure the center rod 30 in position with respect to the frame 12. The rivets 32*a*, 32*b* are also preferably made from steel or may be integrally formed of the same sufficiently strong material that is used to form the center rod 30. The rivets 32*a*, 32*b* secure each end of the center rod 30 proximate the first and the second blade portions 18, 20. The rivets 32*a*, 32*b* also withstand the forces that occur when the pivoting lever 26 is urged in the direction of arrow 28.

If preferred, the opposing ends of the center rod 30 can include screw threads (not shown) and threaded nuts can be used at either or at both ends of the center rod 30. Also if preferred, the opposing ends of the center rod 30 can be bent during assembly to include a ninety-degree bend, thereby eliminating the rivet ends 32*a*, 32*b*. Other means for securing the center rod 30 in position are also possible.

Unlike all known prior art types of opposing parallel blade types of nail clippers, the first blade portion 18 and the second blade portion 20 are separate parts with respect to the frame 12. In addition, the first blade portion 18 and the second blade portion 20 are not formed of a continuous piece of metal that includes the frame 12 (as in prior art nail clippers). Because the first blade portion 18 and the second blade portion 20 are not continuous portions of the frame 12, the need for precision machining of the first cutting and the second cutting edges 19*a*, 21*a* of the curved cutting edge 22 or the straight cutting edge 24 with respect to each other is eliminated. Instead, proper attachment of the first and the second blade portions 18, 20 to the frame 12 is used to ensure proper positioning of the cutting edges 19*a*, 21*a* with respect to one-another for the instant invention.

This greatly reduces the cost of manufacture because the first blade portion 18 and the second blade portion 20, being separate components, are easy to manufacture and to machine the desired cutting edges 19*a*, 21*a* and also because it is easy to ensure proper positioning during assembly. This is discussed in greater detail, hereinafter.

The first and the second blade portions 18, 20 are preferably secured to the upper and lower halves 12*a*, 12*b* of the frame 12 by friction. However, many ways (means) of securing the first and the second blade portions 18, 20 to the frame 12 are possible, such as crimping the first and second blade portions 18, 20 to the frame 12 or by the use of an adhesive. It is also important to note that the center rod 30 passing through the hole through the first and second end portions 13*a*, 13*b* of the frame 12 is also useful in securing and properly aligning the first and the second blade portions 18, 20 with respect to each other.

Now referring also to FIG. 3, is shown an exploded view of the upper half 12*a* of the frame 12 and the first blade portion 18. Construction of the lower half 12*b* of the frame 12 and the second blade portion 20 is similar.

However, the FIG. 3 illustration shows the modified curved cutting edge 22 instead of the straight cutting edge 24 of the first and the second cutting edges 19*a*, 21*a* of FIGS. 1 and 4.

Figure 7:
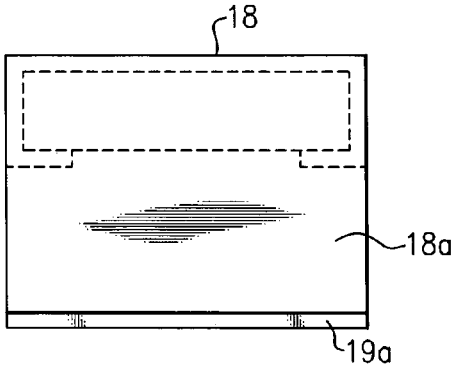
FIG. 7 is an elevational view taken along line 7-7 of a straight cutting edge of the first blade portion of FIG. 3.

Referring momentarily also to FIG. 5, which shows the curvature of the first cutting member 18*a* when viewed from the bottom and also to FIG. 7, which shows how the cutting edge is also planar (i.e., disposed on a horizontal plane). All versions of the instant invention include parallel planar horizontal cutting edges 22, 24 whether the cutting edges 22, 24 are straight (24) or curved (22).

Referring again to FIG. 3, if desired, a pair of protrusions 34*a*, 34*b* may be included on an interior of the first and second blade portions 18, 20 to further secure and help align the first blade portion 18 and the second blade portion 20 with respect to each other and to the frame 12. The protrusions 34*a*, 34*b* extend inward from an interior of the first blade portion 18 and from an interior of the second blade portion 20.

As shown, the first blade portion 18 includes an open end that is located at an opposite end with respect to the first cutting member 18*a*. The open end allows for insertion of the first end portion 13*a* of the upper half 12*a* of the frame within the interior of the first blade portion 18. The second blade portion 20 also includes the open end opposite the second cutting member 20*a* and similarly receives the second end portion 13*b* of the lower half 12*b* of the frame 12.

The first and the second end portions 13*a*, 13*b* of the upper half 12*a* and the lower half 12*b* of the frame 12 may be slightly tapered to allow for easier insertion into the first blade portion 18 (or into the second blade portion 20).

The first and the second end portions 13*a*, 13*b* preferably each include a pair of recesses 36*a*, 36*b*. When the first and the second blade portions 18, 20 are urged sufficiently far over the end portions 13*a*, 13*b* of the frame 12, the recesses 36*a*, 36*b* cooperatively engage with the protrusions 34*a*, 34*b* included on the first and the second blade portions 18, 20 and help secure the first and the second blade portions 18, 20 to the frame 12 at a desired location with respect to the frame 12 and, therefore, the cutting edges 19*a*, 21*a* are also secured in parallel planar alignment with respect to each other.

Once the protrusions 34*a*, 34*b* are engaged within the recesses 36*a*, 36*b*, the first and the second blade portions 18, 20 are secured to the first and the second end portions 13*a*, 13*b* of the upper and lower halves 12*a*, 12*b* of the frame 12.

Alternately if desired, a stopper 38 (partially shown in dashed lines in FIG. 3) may be included as part of the first and the second blade portions 18, 20 especially if the protrusions 34*a*, 34*b* and the recesses 36*a*, 36*b* are omitted. The stopper 38 is used to limit how far the first end 13*a* of the upper half 12*a* and the second end 13*b* of the lower half 12*b* of the frame 12 are inserted into the open end of either the first blade portion 18 or the second blade portion 20.

Referring again to FIG. 2, a gap, identified in general by the reference numeral 5, is provided on a side of the first and second blade portions 18, 20 that is opposite with respect to the top planar surface 9*a* and the bottom planar surface 7*a*. If desired, the gap 5 could be eliminated, however, additional holes (not shown) would need to be provided to allow for passage of the center rod 30 through the metal that would then be present where the gap 5 is currently included on the first and second blade portions 18, 20.

Now referring to FIG. 4, is shown a modified nail clipper with opposing parallel blades, identified in general by the reference numeral 100.

The modified nail clipper with opposing parallel blades 100 includes a plastic straight frame 102 that is reminiscent of the shape of similar prior art all steel nail clippers (not shown). The straight frame 102 includes an upper half 102*a* and a lower half 102*b*.

The upper and lower halves 102*a*, 102*b* of the straight frame 102 are preferably planar in appearance and, as shown, are separate although the upper and the lower halves 102*a*, 102*b* could be molded together as a unit, if preferred and they may include many variations in size, shape, or appearance.

If desired, a wedge 104 can be included at a rear 102*c* of the modified nail clipper with opposing parallel blades 100 between the upper half 102*a* and the lower half 102*b*. The wedge 104 helps to urge the upper half 102*a* and the lower half 102*b* into the quiescent spaced-apart open position where they are disposed maximally apart at a front end, thereof. If desired, the wedge 104 is welded (by ultrasound or other means) to the upper and lower halves 102*a*, 102*b* at the rear 102*c* or adhered (by an adhesive) or the wedge 104 may be molded and included as an integral part of the straight frame 102 so that the wedge 104, the upper half 102*a*, and lower half 102*b* are one continuous piece.

Injection molding or other known or future manufacturing techniques can, of course, be used to form any plastic part of either the nail clipper with opposing parallel blades 10 or the modified nail clipper with opposing parallel blades 100.

A modified pivoting lever 106 is similar to pivoting lever 26 and includes a different shape. The modified pivoting lever 106 is preferably made of plastic and it includes a thickness and strength suitable for the forces it experiences during use. If preferred the pivoting lever 26, as shown in FIG. 1, may instead be used. The modified pivoting lever 106 is pivotally attached to the center rod 30, as previously described for the nail clipper with opposing parallel blades 10. The modified pivoting lever 106 helps illustrate that many possible designs are possible for the pivoting lever 26 or for the modified pivoting lever 106 for any' version of the nail clipper 10, 100.

The modified nail clipper with opposing parallel blades 100 includes the first blade portion 18 and the second blade portion 20 that are identical or substantially similar to that of the nail clipper with opposing parallel blades 10. The first and the second blade portions 18, 20 are secured by friction, or may include the protrusions 34*a*, 34*b* and the recesses 36*a*, 36*b* or the stopper 38, as previously described. Alternately the design of the modified nail clipper with opposing parallel blades 100 (or of the nail clipper with opposing parallel blades 10) may rely entirely on the rivet-like ends 32*a*, 32*b* of the center rod 30 to secure the first and the second blade portions 18, 20 in position.

The first blade portion 18 of the modified nail clipper with opposing parallel blades 100 also includes the first cutting edge 19*a*. The second blade portion 20 of the modified nail clipper with opposing parallel blades 100 also includes the second cutting edge 21*a*. The first and second blade portions 18, 20 are substantially identical to that of the nail clipper with opposing parallel blades 10. In addition, the curved cutting edge 22 or the straight cutting edge 24 may be included on the first cutting edge 19*a*, or the second cutting edge 21*a*, as desired.

When the downward force is applied to the modified pivoting lever 106 in the direction of arrow 28, a lower portion 106*a* of the modified pivoting lever 106 applies the downward force 28 onto the top surface of the first blade portion 18 while the bottom rivet 32*b* of the center rod 30 simultaneously applies an upward force to the bottom of the second blade portion 20. The downward and upward forces urge the first blade portion 18 and the second blade portion 20 closer together.

The downward force supplied by the lower portion 106*a* of the modified pivoting lever 106 along with upward force supplied by the bottom rivet 32*b* of the center rod 30 helps urge the upper and the lower halves 102*a*, 102*b* closer to one-another as the modified pivoting lever 106 is further depressed. This causes the first blade portion 18 and the second blade portion 20 to move toward each other until the first cutting edge 19*a* and the second cutting edge 21*a* align with each and abut other to simultaneously sever the upper and the lower surfaces of the fingernail or toenail placed there-between. This is the same as occurs with the nail clipper with opposing parallel blades 10.

The modified nail clipper with opposing parallel blades 100 shares the advantages of being lightweight, inexpensive to manufacture, available at a low retail cost, able to include space for the advertisement 14 or insert 15, containing a minimal amount of metal (i.e., steel), less chance of detection by airport security devices and most importantly, providing for the simultaneous cutting of both sides of the nail along the entire length of the cutting edges 19*a*, 21*a* while distributing the bulk of the forces and stresses that are experienced to the blades 18, 20 and minimizing the forces and stresses that are experienced by the upper and the lower halves 102*a*, 102*b* of the straight frame 102.

If desired, a retaining clip 108 can be inserted over the rear end 102*c* portions of the straight frame 102 and the wedge 104, to secure them together. The retaining clip 108, if included, is formed of metal or any preferred material, and can be crimped, urged or adhered in place to provide a low-cost manufacturing method.

The retaining clip 108 may include any preferred color and, if desired, may include an opening 105 through the retaining clip 108 and through the rear 102*c* of the modified nail clipper with opposing parallel blades 100 that can be used to receive a key ring (not shown) to attach the nail clipper with opposing parallel blades 100 to a set of keys for easy portability or a ring (not shown) can be attached where desired to any version of the nail clipper 10, 100, 200 (the other versions being described in greater detail, hereinafter).

If desired, for any version of the instant invention, a pair of opposing limits 101*a*, 101*b* (shown in dashed lines) can be included (adhered, fused, welded or molded) into the upper half 102*a* and the lower half 102*b* to limit the degree of motion possible as the first cutting edge 19*a* and second cutting edge 21*a* are urged together. The opposing limits 101*a*, 101*b* abut each other to prevent further motion and can be useful in preventing damage from occurring if excessive force is applied to the modified pivoting lever 106 (or if excessive force is applied to the pivoting lever 26).

If preferred, any portion of any version of the instant invention as described herein that is formed of a plastic, nylon, or polymer, for example, can include either a solid core or a hollow core. Proper selection of materials and skillful design will, of course, allow minimal use of the plastic, nylon, or polymer. Not only does minimal use reduce manufacturing cost, it also reduces weight, which in turn, can substantially reduce shipping costs. This is especially true when compared with the known prior art types of all steel nail clippers. Also, a lower weight makes portage of the instant invention easier to accomplish, whether it is placed in a pocket, purse, or added to a keychain, for example.

What is especially important to note is that the design of the nail clipper with opposing parallel blades 10 and the modified nail clipper with opposing parallel blades 100 and any related version of the instant invention is that the first and the second blade portions 18, 20 are extended (i.e., include a sufficiently long [or extended] top planar surface 9*a* and a sufficiently long [or extended] bottom planar surface 7*a*) to allow the center rod 30 to pass through the first and the second blade portions 18, 20 and to also apply the downward force during use to the top planar surface 9*a* of the first blade portion 18 by the pivoting lever 26 or by the modified pivoting lever 106. Accordingly, the downward cutting force is applied directly to the first blade portion 18. Similarly, the upward force during cutting is applied directly to the second blade portion 20.

The instant invention, thereby, provides a significant benefit over the known prior art types of all steel nail clippers with parallel opposing blades by allowing the use of the frame 12, 102 made of plastic and attached steel first and second blade portions 18, 20 which are easily capable of withstanding the mechanical stresses that occur during use (i.e., cutting of the fingernail or toenail.)

The instant invention also provides a significant improvement over the plastic frame and steel blade versions that are disclosed in the earlier-filed related patent applications that applied the downward and upward forces to the plastic frame members which then transferred these forces to the steel blades. The earlier-described plastic frame members of the related patent applications experience considerable mechanical stress, especially at the interface to the steel blades, and are, therefore, more subject to fracture or deformation.

However, the instant invention, by applying the forces directly to the top and bottom planar surfaces 9*a*, 7*a* of the first and second blade portions 18, 20, respectively, the plastic frame 12, 102 is spared from much of the mechanical stress that occurs during cutting. The first and the second blade portions 18, 20 are easily able to withstand such forces and mechanical stresses. With the instant invention very little stress is experienced by the frame 12, 102 during cutting of the nail. The frame 12, 102 of the instant invention is used, primarily, to maintain alignment of the cutting edges 19*a*, 21*a* of the first and the second blade portions 18, 20 with respect to each other and to urge the first and second blade portions 18, 20 apart after each cut has been accomplished.

Figure 8:
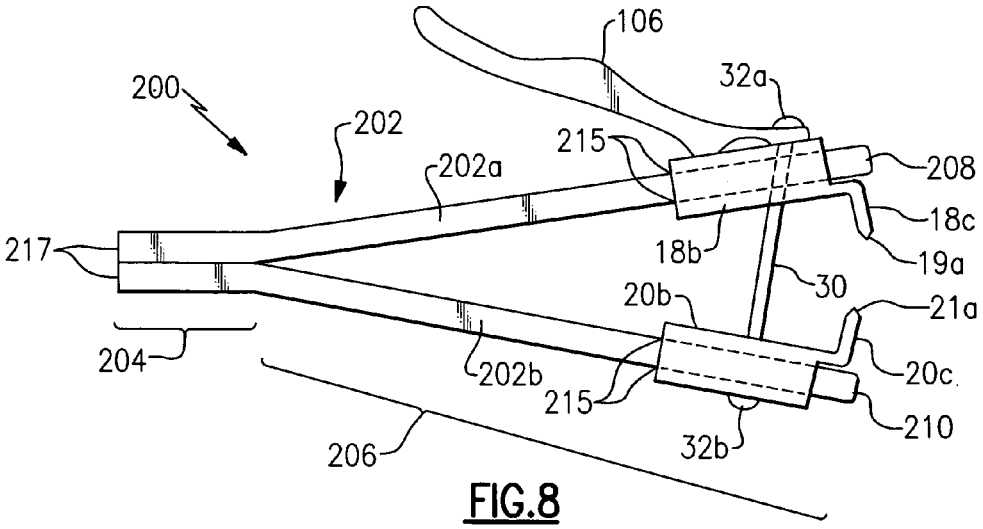
FIG. 8 is a side view of a second modified embodiment of the nail clipper with opposing parallel blades of FIG. 1.

Referring now to FIG. 8 is shown a second modified nail clipper with opposing parallel blades, identified in general by the reference numeral 200.

The second modified nail clipper with opposing parallel blades 200 includes a plastic modified straight frame, as identified in general by reference numeral 202, that includes a modified upper half 202*a* and a modified lower half 202*b*.

The modified upper half 202*a* and the modified lower half 202*b* of the modified straight frame 202 each include a rear straight portion, identified by bracket 204, and a forward straight portion, identified by bracket 206. The rear straight portions 204 of the modified upper half 202*a* and the modified lower half 202*b* are fused together or sonically welded together or adhered together or molded together to form the modified straight frame 202. This eliminates the need for the retaining clip 108. By selection of the materials used, including control of the thickness it is also possible to eliminate the wedge 104 with the second modified nail clipper with opposing parallel blades 200. The wedge 104 may also be eliminated from any other version, as desired if normal hysteresis is sufficient to urge the nail clipper 10, 100, 200, 300 into the open position or if a spring 109 (see FIG. 4) is included.

The second modified nail clipper with opposing parallel blades 200 shows a modification to the blades 18, 20 that is possible with all versions. A modified first blade portion 18*b* includes a modified first cutting member 18*c*. The modified first cutting member 18*c* extends downward from a bottom of the modified first blade portion 18*b* (instead of from the top). The modified first blade portion 18*b* is made of steel or any sufficiently strong material. A remainder of the modified first blade portion 18*b* (other than the modified first cutting member 18*c*) wraps around at least a portion of the modified upper half 202*a*, as is common with all versions of the invention.

In particular, the modified first blade portion 18*b* extends over the top of the modified upper half 202*a* (or over the top of an end of any upper plastic half 12*a*, 102*a*) to ensure that the modified pivoting lever 106 (or any pivoting lever 26) will bear down on the hard steel surface of the modified first blade portion 18*b* and not on the plastic of the modified upper half 202*a* (i.e., not on the plastic upper half 12*a*, 102*a* of any version).

A modified second blade portion 20*b* includes a modified second cutting member 20*c*. The modified second cutting member 20*c* extends upward from a top of the modified second blade portion 20*b*, toward the modified first cutting member 18*c*. The modified second blade portion 20*b* is similarly made of steel or any sufficiently strong material, as desired. A remainder of the modified second blade portion 20*b* (other than the modified second cutting member 20*c*) wraps around at least a portion of the modified lower half 202*b*, as is common with all versions of the invention.

In particular, the modified second blade portion 20*b* extends over the bottom of the modified lower half 202*b* (or over the bottom of an end of any lower plastic half 12*b*, 102*b*) to ensure that the lower or bottom rivet-like end 32*b* will bear upwards against the hard steel surface of the modified second blade portion 20*b* during use (i.e., during cutting of the fingernail or toenail) and not bear on the plastic of the modified lower half 202*b* (i.e., not on the plastic lower half 12*b*, 102*b* of any version).

This configuration allows for a portion of the modified upper half 202*a* to extend forward of the modified first blade portion 18*b* and to function as an upper safety bumper 208. It also allows for a portion of the modified lower half 202*b* to extend forward of the modified second blade portion 20*b* and to function as a lower safety bumper 210.

During use, a fleshy part of any finger, thumb, or toe (not shown) that is disposed under the fingernail or toenail will contact one of the safety bumpers 208, 210 and help to limit the depth of cut that is possible. This prevents excessive cutting from occurring and can prevent injury or bleeding. The risk of infection from a cut is also greatly reduced. The amount of protrusion of the safety bumpers 208, 210 can also be varied to provide different types of cut (i.e., longer or shorter fingernails and toenails), as desired.

The configuration of the second modified nail clipper with opposing parallel blades 200 provides an advantage during manufacture. The upper safety bumper 208 and the lower safety bumper 210 include a thickness that is less than a thickness of a remainder of the modified upper half 202*a* and a remainder of the modified lower half 202*b*. A step 215 is provided at the modified upper half 202*a* and at the modified lower half 202 an equal distance from a left end 217. The step 215 is where the thickness of the modified upper half 202*a* and the modified lower half 202*b* decreases to the lesser thickness of the upper safety bumper 208 and the lower safety bumper 210. It should be noted that the modified first blade portion 18*b* and the modified second blade portion 20*b* are identical components that are installed during manufacture on the modified upper half 202*a* and on the modified lower half 202*b* in an upside-down relationship with respect to each other. This lowers cost of manufacture by using the same component part for both the modified first blade portion 18*b* and the modified second blade portion 20*b*.

During manufacture, the modified first blade portion 18*b* and the modified second blade portion 20*b* are placed over the ends of the upper safety bumper 208 and the lower safety bumper 210 and urged in a direction toward the left end 217 until the modified first blade portion 18*b* and the modified second blade portion 20*b* make contact with each respective step 215. Friction or protrusions and recesses or the center post 30 or other means, as desired, retain the modified first blade portion 18*b* and the modified second blade portion 20*b* in position. See also FIG. 9 for an alternate way of securing the second blade portion 20.

This method of construction and assembly ensures that the first cutting edge 19*a* and the second cutting edge 21*a*, which are included on the modified first cutting member 18*c* and the modified second cutting member 20*c*, will also be disposed the same distance away from the left end 217 and, therefore, align with respect to each other during use (i.e., cutting of the fingernail or toenail). As such, a simple and especially low cost method of manufacture is provided that ensures rapid assemble and proper alignment of the first cutting edge 19*a* and the second cutting edge 21*a* with respect to each other.

As mentioned earlier, a primary significant advantage is provided by any version of the instant invention. The force necessary to urge the first and second cutting edges 19*a*, 21*a* together is applied to the first and second blade portions 18, 20 (or to the modified first and second blade portions 18*b*, 20*b* or to the blade portions of any version of the instant invention) and not to the material (i.e., the plastic) that is used to form the upper halves 12*a*, 102*a*, 202*a* and the lower halves 12*b*, 102*b*, 202*b*.

To illustrate this benefit refer momentarily to FIG. 1. When the pivoting lever 26 of the instant invention is urged in a downward direction, the lower portion 26*a* of the pivoting lever 26 is applying the downward force 28 to the top planar surface 9*a* of the steel of the first blade portion 18 and a simultaneous upward force is being applied to the top of the center rod 30 at the upper rivet-like end 32*a*. Simultaneously, the lower rivet-like end 32*b* is applying an upward force to urge the bottom planar surface 7*a* of the second blade portion 20 in an upward direction toward the first blade portion 18.

Accordingly, the majority of the cutting forces are experienced by the first and second blade portions. 18, 20 and not by the plastic material of the frame 12. The upper half 12*a* and the lower half 12*b* of the frame 12 experience only mild forces as they are urged toward one-another during the cutting of the fingernail or toenail. The minimal force that is experienced by the upper half 12*a* and the lower half 12*b* of the frame 12 is transferred to the upper half 12*a* and the lower half 12*b* by the first and second blade portions 18, 20 as they are being urged toward one-another.

The upper half 12*a* and the lower half 12*b* of the frame 12 provide two especially important functions. First, they maintain proper alignment of the first blade portion 18 with respect to the second blade portion 20 to ensure that the first cutting edge 19*a* and the second cutting edge 21*a* are always parallel with respect to one-another (for any position, open or closed of the nail clipper with opposing parallel blades 10) and to ensure that the first cutting edge 19*a* and the second cutting edge 21*a* will abut one-another when the nail clipper with opposing parallel blades 10 is urged into the fully closed position. Second, the upper half 12*a* and the lower half 12*b* of the frame 12 are used to supply the outward force that urges the first blade portion 18 apart from the second blade portion 20 into the open position when the pivoting lever 26 is not being urged in a downward direction (i.e., when not cutting the fingernail or the toenail). The outward force is supplied by the natural hysteresis of the frame 12 or by the wedge 16 or the spring 109 (see FIG. 4), as desired.

Although explained in detail for the nail clipper with opposing parallel blades 10 the above-described benefits apply to all versions of the instant invention where the lower portion 26*a*, 106*a* of the pivoting lever 26 or the modified pivoting lever 106 bears down on the top planar surface 9*a* of the first blade portion 18, or on the modified first blade portion 18*b* rather than bearing down directly on any portion of the plastic frame 12, 102, 202.

To better appreciate the benefit of the instant invention consider that a great deal of force is required to urge the blade portions 18, 20, 18*b*, 20*b* together while simultaneously cutting across the width of the first and second cutting edges 19*a*, 21*a*. If the force is applied to the plastic frame portions of the upper halves 12*a*, 102*a*, 202*a* and the lower halves 12*b*, 102*b*, 202*b* as taught by prior art types of nail clippers with opposing parallel cutting blades (instead of being applied to the steel portion of the first blade 18), it (i.e., the force necessary to sever the nail) must then be transferred from the plastic frame portions of the upper halves 12*a*, 102*a*, 202*a* and the lower halves 12*b*, 102*b*, 202*b* to the equivalent prior art blade portions 18, 20, 18*b*, 20*b*.

The force required is so substantial that there is likelihood of distortion (i.e., bending) or even breakage (i.e., cracking) of the upper halves 12*a*, 102*a*, 202*a* and the lower halves 12*b*, 102*b*, 202*b* occurring if the force is applied to the plastic frame 12, 102, 202 instead of being applied to the (steel) blade portions 18, 20, 18*b*, 20*b*. The instant design prevents the upper halves 12*a*, 102*a*, 202*a* and the lower halves 12*b*, 102*b*, 202*b* (i.e., the plastic frame 12, 102, 202) from experiencing such strong forces and mechanical stress during the cutting of the fingernail or toenail. As such, a much more durable device is provided and at very low cost.

Referring now to FIG. 9 is shown a portion of a third modified nail clipper with opposing parallel blades, identified in general by the reference numeral 300. The third modified nail clipper with opposing parallel blades 300, as shown, includes the modified first and second blades 18*a*, 20*b* of the second modified nail clipper with opposing parallel blades 200.

The third modified nail clipper with opposing parallel blades 300 includes an optional first modified lower safety bumper 302. A remainder of the third modified nail clipper with opposing parallel blades 300 is similar to the second modified nail clipper with opposing parallel blades 200. The upper half 12*a* and the lower half 12*b* of the frame 12 of the nail clipper with opposing parallel blades 10 could be used with the third modified nail clipper with opposing parallel blades 300, if desired. Many variations are, of course, possible for the frame 12, the straight frame 102 and the modified straight frame 202 with any version of the nail clipper 10, 100, 200, 300.

The first modified lower safety bumper 302 extends outward from the modified second blade portion 20*b* beyond the second cutting edge 21*a*, and includes a curved profile 304 that corresponds, in general, with the curvature of a fleshy part of a finger or toe.

During use, a finger 306 (or toe) is urged in the direction of arrow 307 so that a curved fleshy part 308 of the finger 306 makes contact with the curved profile 304 of the first modified lower safety bumper 302. A fingernail 310 of the finger 306 is placed between the first cutting edge 19*a* and the second cutting edge 21*a* when the third modified nail clipper with opposing parallel blades 300 is disposed in the open position, as shown. The user applies slight pressure of the fleshy part 308 against the curved profile 304 while urging the pivoting lever 26 in a downward direction sufficient to sever at least some of the fingernail 310.

The above-described procedure for cutting the fingernail 310 is repeated for all of the fingernails 310 and all of the toenails of the person. For each fingernail 310 more than one cut will often be required to give the fingernail 310 its desired finished appearance. The above-described procedure, in general, for cutting the fingernail 310 is used with all versions of the nail clipper 10, 100, 200, 300, whether or not the first modified lower safety bumper 302, or any version of a safety bumper is included.

It is to be understood that the amount that the curved profile 304 protrudes in a direction opposite that of arrow 307 is a design variable. A greater amount of the protrusion of the curved profile 304 will result in a smaller amount of the fingernail 310 that will be severed for any given force (that the user applies) of the fleshy part 308 on the curved profile 304 portion of the first modified lower safety bumper 302 in the direction of arrow 307. Conversely, a lesser amount of the protrusion of the curved profile 304 will result in a greater amount of the fingernail 310 that will be severed for any given force applied because a greater amount of the fingernail 310 will extend between the first cutting edge 19*a* and the second cutting edge 21*a* (in the direction of arrow 307).

The curved profile 304 provides numerous advantages and can be adapted for use with different embodiments or versions of the invention, as desired.

The curved profile 304 provides a "controlled" cutting experience. The user cannot inadvertently remove too much of the fingernail 310. Removal of a greater amount of the fingernail 310 requires a deliberate action, as described below. The user is assured of receiving the type of cut that is desired.

A comfortable cutting experience is also provided because a substantial (i.e., a greater) area of the fleshy part 308 is in contact with the curved profile 304 during cutting. The larger contact area eliminates the possibility of an uncomfortable pressure point occurring. The cutting experience is more comfortable whether a slight force or greater force is applied urging the fleshy part 308 against the curved profile 304.

During use, another advantage is realized if the user applies a slight pressure initially during cutting. A slight pressure (for any degree of protrusion of the first modified lower safety bumper 302) is used to remove a minimal amount of the fingernail 310. This allows for light trimming or, if desired, a French-cut type of manicure.

Another significant advantage is provided after accomplishing an initial light trimming if, after viewing, the user desires to remove even more of the fingernail 310. The user can again place the fingernail 310 in the proper position for cutting while applying an even greater force urging the fleshy part 308 against the curved profile 304 in the direction of arrow 307 during cutting of the fingernail 310. This will remove an even greater amount of the fingernail 310. In this manner the desired cut is obtained. And, as mentioned above, deeper cutting requires a deliberate action (i.e., intentionally applying more force during cutting) which helps to prevent undesired excessive fingernail 310 removal from occurring.

The third modified nail clipper with opposing parallel blades 300 illustrates how only the one (i.e., lower) side need include the safety bumper (in this instance, the first modified lower safety bumper 302) in order to obtain the benefits provided by the first modified lower safety bumper 302. It is important to understand that inclusion of the first modified lower safety bumper 302 (or any other type of safety bumper) with any version of the nail clipper 10, 100, 200, 300 is optional. Any version of the safety bumper 208, 210, 302 can be eliminated from the upper half of the third modified nail clipper with opposing parallel blades 300. This is also equally true with the second modified nail clipper with opposing parallel blades 200 and with any other embodiment of the invention. If preferred, any desired version of the safety bumper 208, 210, 302 can be included on both sides (i.e., proximate both the first cutting edge 19*a* and the second cutting edge 21*a*). It is also true that any version of the instant invention (10, 100, 200, 300), including other embodiments not shown herein, may omit the safety bumper 208, 210, 302, as desired.

The curved profile 304 of the first modified lower safety bumper 302 can also be used to retain the modified second blade portion 20*b* in position on the lower half 12*b* of the frame 12. This helps ensure proper positioning of the second cutting edge 21*a* from a distal end 312 of the third modified nail clipper with opposing parallel blades 300. The curved profile 304 of the first modified lower safety bumper 302 can also be repeated with the modified first blade portion 18*b* to provide the desired alignment benefit of the first cutting edge 19*a* with respect to the distal end 312 and, therefore, with the second cutting edge 21*a*. The first modified lower safety bumper 302 can be attached to an end of the lower half 12*b* during assembly of it can be molded in place, as desired.

The third modified nail clipper with opposing parallel blades 300, as shown, also includes an optional molded insert 314 proximate the distal end 312 between the upper half 12*a* and the lower half 12*b* of the frame 12. The molded insert 314 may be optionally included for a variety of reasons. The molded insert 314 can be formed of a more elastomeric type of material and function as a separating wedge by supplying an outward force to help urge the upper half 12*a* and the lower half 12*b* apart from each other. Also, the molded insert 314 can include a contrasting appearance for aesthetic enhancement. The molded insert 314 may also include inner channels 316 (shown in dashed lines) that are disposed in the upper half 12*a* and the lower half 12*b* of the frame 12 that, during manufacture, are used to convey an additional quantity of the material that is used to form the molded insert 314 to an upper exterior strip 318 and to a lower exterior strip 320. The upper exterior strip 318 and the lower exterior strip 320 help provide non-slip exterior surfaces that improves grip. The upper exterior strip 318 and the lower exterior strip 320 also help to provide enhanced appearance and attractiveness by providing a contrasting accent color. If desired, either or both of the upper exterior strip 318 and the lower exterior strip 320 can also be molded to include any desired indicia, brand name, logo or other desired markings, such as the advertisement 14.

It is also anticipated that a set of several of the third modified nail clippers with opposing parallel blades 300 (or other version of the nail clipper 10, 100, 200, 300) can be provided, each having a different length of protrusion of the curved profile 304 portion of the first modified lower safety bumper 302. If desired, a unique number could be assigned to each one of the several of the third modified nail clippers with opposing parallel blades 300 so that an average depth of cut of the fingernail 310 is associated with each particular number.

For example, a number one (1) could have a very large protrusion and thereby, the smallest amount of cut, whereas a number ten (10) might have the smallest protrusion possible and, thereby, the greatest amount of fingernail 310 cut occurring. These could be offered for sale individually. Individuals (users) could then purchase a version of the invention that corresponds with the depth of cut that they generally prefer.

Also, manicurists and pedicurists are likely to purchase a set that includes several different depths of cut (i.e., inversely proportional to the length of protrusion of the fleshy part 308 of the first modified lower safety bumper 302) to use with their clients. Manicurists and pedicurists are likely to purchase one or a set of nail clippers (10, 100, 200, 300) that is especially durable and designed for a very long life and, in particular, for commercial use.

Figure 10:
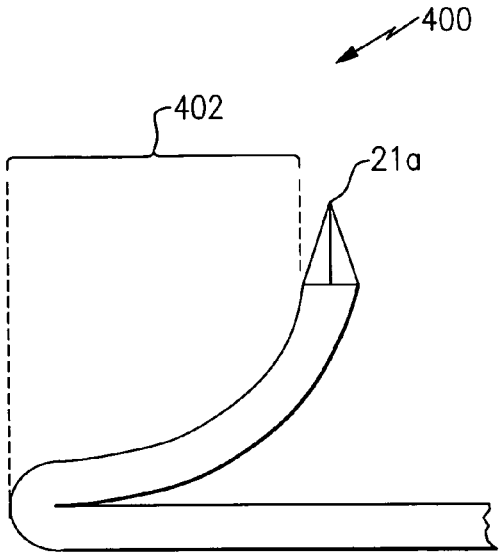
FIG. 10 is a side view of a front portion of a modified lower cutting blade.

It is also important to note that the benefits of the safety bumper (208, 210, 302) can also be applied to improve the performance of any prior art type of nail clipper (not shown). For example, referring now to FIG. 10, is shown a side view of a front portion of a modified lower cutting blade, identified in general by the reference numeral 400.

The modified lower cutting blade 400 can be used with the nail clipper with opposing parallel blades 10, the modified nail clipper with opposing parallel blades 100, the third modified nail clipper with opposing parallel blades 300, or with any other embodiment of the invention by including the curved profile 304 (of the first modified lower safety bumper 302) into the shape of the lower blade 20, 20*b* by a bending of the steel that is used to form the blade 20, 20*b*.

The amount of protrusion forward of the second cutting edge 21*a* is indicated by bracket 402. Accordingly, the amount of protrusion can be varied along with its curvature profile, as previously described for the first modified lower safety bumper 302, to provide any desired depth of cut.

It is important to note that the modified lower cutting blade 400 can be used with any desired prior art type of steel nail clipper (not shown, of the type where the blade and upper and lower body members are formed of steel) to provide a version of the safety bumper.

Any of the teachings for any version of the instant invention can be applied, as desired, to any other version or to any further modified version (not shown) without departing from the spirit and scope of the invention.

It is also understood that any possible embodiment or version of the nail clipper (10, 100, 200, 300) can include either the straight cutting edge 24, as shown in FIG. 6, or the curved cutting edge 22, as shown in FIG. 5, as preferred. The curved cutting edge 22 is generally preferred because when the opposing parallel cutting edges 19*a*, 21*a* are urged together, a curved cut of the fingernail 310 occurs that is closer in shape to a curvature of the fingernail 310 that many people prefer. However, the straight cutting edge 24 is also possible and may be less expensive to manufacture. Accordingly, versions of the nail clipper (10, 100, 200, 300) that include the straight cutting edge 24 may be less expensive to purchase.

Approximating a desired overall curvature of the fingernail 310 is possible with the straight cutting edges 19*a*, 21*a* by taking numerous small cuts along the perimeter of the fingernail 310. If desired, an optional file (not shown) may be used to smooth the fingernail 310 after cutting regardless of whether curved or straight cutting edges 22, 24 are used.

Figure 11:
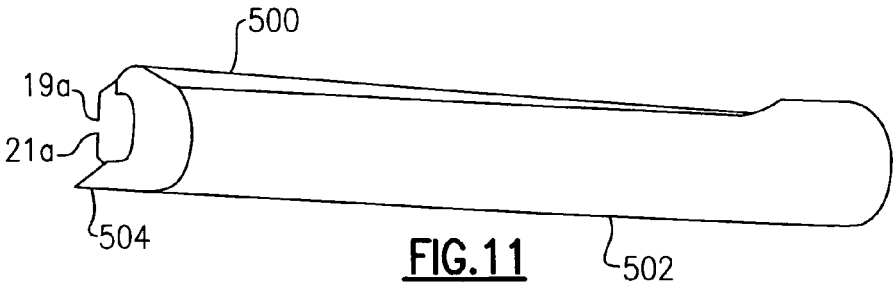
FIG. 11 is a partial side view of a prior art type of a steel blade and steel body nail clipper with a plastic surround sleeve that includes a lower safety bumper attached, thereto.

Referring now to FIG. 11, is shown a partial side view of a prior art type of a steel blade and steel body nail clipper 500 with a plastic surround sleeve 502 that is disposed over and which surrounds the prior art clipper 500 for the purpose of catching nail clippings during use. The sleeve 502 includes a sleeve protrusion 504 that extends forward of the cutting edges 19*a*, 21*a*. The sleeve protrusion 504 includes any desired taper or curvature and functions as a further modified type of the safety bumper.

Figure 12:
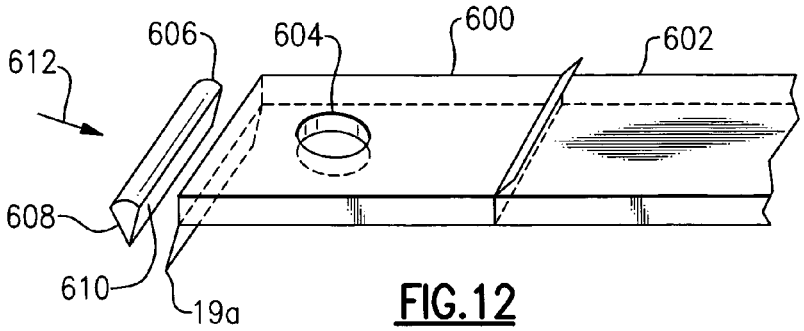
FIG. 12 is a view in perspective of a version of a blade of the current invention with an adhesive safety bumper disposed in a spaced-apart orientation for clarity prior to its adhesion to the blade.

Referring now to FIG. 12 is shown a view in perspective of a type of blade 600 of the current invention. The blade 600 is made of steel and surrounds a plastic member 602. This illustrates that the blade 600 can completely surround the plastic member 602 or, if preferred, it can include less material and not fully wrap around and surround the inside portions of the members (as shown in FIG. 2).

A hole 604 is provided through the blade 600 and through the plastic member 602 for the center rod 30 to pass therethrough. The hole 604 and the center rod 30 also provide an alternate means for properly aligning the cutting edge 19*a* a desired distance away from a distal portion (not shown) of the plastic member 602 to ensure that the first cutting edge 19*a* will align with the lower second cutting edge 21*a* that is similarly secured to a lower plastic member (not shown).

An adhesive safety bumper 606 is shown in a spaced-apart orientation prior to its adhesion to a front surface of the blade 600 (and/or plastic member 602) above the first cutting edge 19*a*. The adhesive safety bumper 606 includes any desired curvature 608 for contact with the fleshy part 308 of the finger 306 which helps to control or limit the amount of cut that occurs. An adhesive coating is applied to a contact surface 610 of the adhesive safety bumper 606 and is used to secure the adhesive safety bumper 606 in position.

A protective covering (not shown) is removed from the contact surface 610 and the adhesive safety bumper 606 is urged in the direction of arrow 612 until it makes contact with the front surface of the blade 600 (and/or plastic member 602) above the first cutting edge 19*a*. In this manner, a method and apparatus are shown for providing a safety bumper on prior art types of nail clippers.

Figure 13:
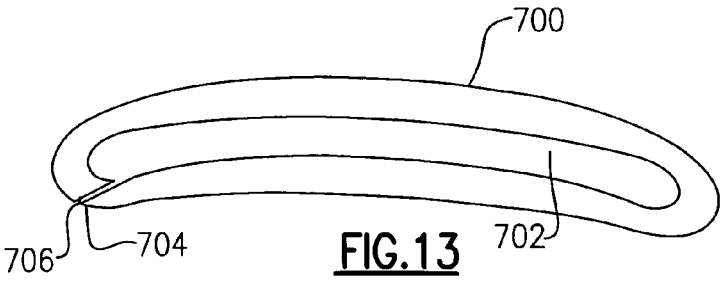
FIG. 13 is a cross-sectional view of a snap-on safety bumper for use with a prior art nail clipper.

Referring now to FIG. 13 is shown a cross-sectional view of a snap-on safety bumper 700 for use with existing prior art nail clippers. The snap-on safety bumper 700 forms a complete enclosure and is hollow along a curved center longitudinal length 702. The curved center longitudinal length 702 corresponds with a cross-sectional view of a blade portion of a prior-art type of nail clipper.

The snap-on safety bumper 700 preferably includes a slit 704 so it can be opened and easily inserted around one or both of the blades of the prior-art type of nail clipper. A latch 706 is provided at the slit 704 to retain the snap-on safety bumper 700 in a closed position, after installation. The latch 706 can include a spherical protrusion on one side of the slit 704 that engages with and is retained by a spherical opening on an opposite side of the slit 704.

It is to be understood that numerous variations in the shape, placement and configuration of the pivoting lever 26 are, of course, possible and each configuration provides a means for urging the first and second cutting edges 19*a*, 21*a* toward each other. However, the means for urging the first and second cutting edges 19*a*, 21*a* toward each other for all embodiments of the instant invention apply a first downward force to a portion (i.e., to the top planar surface 9*a*) of the first blade portion 18, or the modified first blade portion 18*b*, urging the first blade portion 18, or the modified first blade portion 18*b* in a first downward direction toward the second blade portion 20 or toward the modified second blade portion 20*b* while simultaneously applying a second upward force to a portion (i.e., to the bottom planar surface 7*a*) of the second blade portion 20 or the modified second blade portion 20*b*, urging the second blade portion 20 or the modified second blade portion 20*b* in a second upward direction toward the first blade portion 18 or toward the modified first blade portion 18*b*, and wherein the second direction is opposite with respect to the first direction.

In this manner, the first and second forces are applied directly to the blades 18, 18*b*, 20, 20*b* and not to the plastic frame 12, 102, 202. As previously described, this greatly reduces the magnitude of stress and strain that is experienced by the plastic frame 12, 102, 202. The plastic frame 12, 102, 202 maintains the first and second cutting edges 19*a*, 21*a* of the first and second blade portions 18, 20 or the modified first and second blade portions 18*b*, 20*b* in a proper parallel alignment with respect to each other when the nail clipper 10, 100, 200, 300 is disposed in an open position and while the first and second blade portions 18, 20 or the modified first and second blade portions 18*b*, 20*b* are urged toward each other, and also when the cutting action is complete and the length of the first cutting edge 19*a* abuts (i.e., is in contact with) the length of the second cutting edge 21*a*, at which time the nail clipper 10, 100, 200, 300 is disposed in a second, closed position.

Accordingly, a lightweight, inexpensive, and attractive nail clipper 10, 100, 200, 300 that has a plastic frame 12, 102, 202 and steel blades 18, 18*b*, 20, 20*b* is provided that can easily cut through the toughest fingernails 310 and toenails. It is also possible to use materials other than plastic for the frame 12, 102, 202 and it is also possible to use materials other than steel for the first and second blade portions 18, 20 or the modified first and second blade portions 18*b*, 20*b* without departing from the spirit and scope of the invention. For example, a ceramic material may be used for the first and second blade portions 18, 20 or the modified first and second blade portions 18*b*, 20*b*, however the first and second forces would still be applied directly to the first and second blades 18, 20 or to the modified first and second blade portions 18*b*, 20*b*, respectively, and not directly to the frame 12, 102, 202, regardless of the material that is used to form the frame 12, 102, 202. Similarly, the frame 12, 102, 202 could be formed of any desired material that provides sufficient flexibility, such as certain types of carbon fiber or other synthetic materials.

There are numerous ways of urging the upper and lower halves 12*a*, 12*b*, 102*a*, 102*b*, and 202*a*, 202*b* of the plastic frame 12, 102, 202 apart into the open position. The hysteresis that is inherent with the material used to form the frame 12, 102, 202 supplies a force that is useful in urging the upper and lower halves 12*a*, 12*b*, 102*a*, 102*b*, and 202*a*, 202*b* into the open position. The additional amount of plastic material 16, if included, also supplies a force that is useful in urging the upper and lower halves 12*a*, 12*b*, 102*a*, 102*b*, and 202*a*, 202*b* into the open position. The wedge 104, if included, also supplies a force that is useful in urging the upper and lower halves 12*a*, 12*b*, 102*a*, 102*b*, and 202*a*, 202*b* into the open position. The molded insert 314, if included, also supplies a force that is useful in urging the upper and lower halves 12*a*, 12*b*, 102*a*, 102*b*, and 202*a*, 202*b* into the open position. If desired, the spring 109 (see FIG. 4) can also be included to supply a force that is useful in urging the upper and lower halves 12*a*, 12*b*, 102*a*, 102*b*, and 202*a*, 202*b* into the open position. Each of these supply means for urging the upper and lower halves 12*a*, 12*b*, 102*a*, 102*b*, and 202*a*, 202*b* into the open position.

Referring again to FIG. 9, a modified center rod 30*a* is included that includes the lower rivet end 32*b*. A retaining pin 32*c* passes through a hole provided in the pivoting lever 26 and through a corresponding hole provided in the modified center rod 30*a*. The pivoting lever 26 pivots about the retaining pin 32*c* during use. The center rod 30 or the modified center rod 30*a* or the retaining pin 32*c* can be formed of any desired type of plastic, metal or synthetic material.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A nail clipper, comprising:

(a) a body made of a first material, said body including a first portion that includes an upper half of said body and a second portion that includes a lower half of said body, and wherein said first portion includes a first end and wherein said second portion includes a second end, and wherein said first end is disposed a first predetermined distance away from said second end when said nail clipper is disposed in an open position, and wherein said first end is disposed a second predetermined distance away from second end when said nail clipper is disposed in a closed position, and wherein said first predetermined distance is greater than said second predetermined distance, and wherein said first portion includes an outside surface that is disposed maximally away from said second portion, and wherein said second portion includes an outside surface that is disposed maximally away from said first portion, and wherein said first portion includes an inside surface that is disposed proximate to an inside surface of said second portion;

(b) a first blade and a second blade, wherein said first blade and said second blade are made of a different material than said body, and wherein said first blade is attached to said first end of said first portion, and wherein said second blade is attached to said second end of said second portion, and wherein a cutting edge of said first blade is parallel with respect to a cutting edge of said second blade when said nail clipper is disposed in said open position, and wherein said cutting edge of said first blade is disposed a predetermined distance away from said cutting edge of said second blade when said nail clipper is disposed in said open position, and wherein said first blade includes a top planar surface;

(c) means for urging said cutting edge of said first blade and said cutting edge of said second blade toward each other, said means for urging attached to said nail clipper, and wherein said means for urging applies a first force to said first blade in a first direction that urges said first blade toward said second blade;

wherein said means for urging applies said first force to said top planar surface of said first blade sufficient to urge said cutting edge of said first blade toward said cutting edge of said second blade and wherein as said cutting edge of said first blade is urged toward said cutting edge of said second blade, said first blade is urged toward said second blade, and wherein as said first blade is urged toward said second blade, said first blade urges said first end of said first portion of said upper half of said body toward said second end of said second portion of said lower half of said body.

2. A nail clipper, comprising:

(a) a body made of a plastic or a synthetic or a composite material or a combination of plastic, synthetic or composite materials, said body including a first portion that includes an upper half of said body and a second portion that includes a lower half of said body, and wherein said first portion includes a first end and wherein said second portion includes a second end, and wherein said first end is disposed a first predetermined distance away from said second end when said nail clipper is disposed in an open position, and wherein said first end is disposed a second predetermined distance away from second end when said nail clipper is disposed in a closed position, and wherein said first predetermined distance is greater than said second predetermined distance, and wherein said first portion includes an outside surface that is disposed maximally away from said second portion, and wherein said second portion includes an outside surface that is disposed maximally away from said first portion, and wherein said first portion includes an inside surface that is disposed proximate to an inside surface of said second portion;

(b) a first blade and a second blade, wherein said first blade and said second blade are made of a different material than said body, and wherein said first blade is attached to said first end of said first portion, and wherein said second blade is attached to said second end of said second portion, and wherein a cutting edge of said first blade is parallel with respect to a cutting edge of said second blade when said nail clipper is disposed in said open position, and wherein said cutting edge of said first blade is parallel with respect to said cutting edge of said second blade when said nail clipper is disposed in said closed position and wherein said cutting edge of said first blade is disposed a predetermined distance away from said cutting edge of said second blade when said nail clipper is disposed in said open position, and wherein said first blade includes a top planar surface and wherein said second blade includes a bottom planar surface;

(c) means for urging said cutting edge of said first blade and said cutting edge of said second blade toward each other, said means for urging attached to said nail clipper, and wherein said means for urging applies a first force to said first blade in a first direction that urges said first blade toward said second blade, and wherein said means for urging applies a second force to said second blade in a second direction, and wherein said second direction is opposite to that of said first direction;

wherein said means for urging said cutting edge of said first blade toward said cutting edge of said second blade includes a lever, and wherein a portion of said lever applies said first force directly to said top planar surface of said first blade when said lever is urged in a predetermined direction sufficient to urge said first blade and said second blade toward each other;

wherein said means for urging applies said first force to said top planar surface of said first blade and said means for urging applies said second force to said bottom planar surface of said second blade sufficient to urge said cutting edge of said first blade toward said cutting edge of said second blade and to simultaneously urge said cutting edge of said second blade toward said cutting edge of said first blade, and wherein as said cutting edge of said first blade is urged toward said cutting edge of said second blade, said first blade is urged toward said second blade, and wherein as said first blade is urged toward said second blade, said first blade urges said first end of said first portion of said upper half of said body toward said second end of said second portion of said lower half of said body, and wherein as said cutting edge of said second blade is urged toward said cutting edge of said first blade, said second blade is urged toward said first blade, and wherein as said second blade is urged toward said first blade, said second blade urges said second end of said second portion of said lower half of said body toward said first end of said first portion of said upper half.

3. The nail clipper of claim 2 wherein said first blade includes a top planar surface that extends over a portion of said outside surface of said first portion, and wherein said second blade includes a bottom planar surface that extends over a portion of said outside surface of said second portion.

4. The nail clipper of claim 3 wherein said means for urging said cutting edge of said first blade toward said cutting edge of said second blade includes a pivoting lever, and wherein a portion of said lever applies said first force to said top planar surface of said first portion when said lever is urged in a predetermined direction sufficient to urge said first blade and said second blade of said nail clipper away from said open position toward said closed position, and wherein when said nail clipper is disposed in said closed position a longitudinal length of said cutting edge of said first blade is disposed adjacent to a longitudinal length of said cutting edge of said second blade.

5. The nail clipper of claim 4 wherein when said nail clipper is disposed in said closed position said longitudinal length of said cutting edge of said first blade is in contact with said longitudinal length of said cutting edge of said second blade.

6. The nail clipper of claim 4 wherein when said nail clipper is disposed in said closed position said longitudinal length of said cutting edge of said first blade abuts said longitudinal length of said cutting edge of said second blade.

7. The nail clipper of claim 2 wherein said nail clipper includes means for urging said first end of said first portion said first predetermined distance away from said second end of said second portion when said first force is not being applied.

8. The nail clipper of claim 7 wherein said means for urging said first end of said first portion said predetermined distance away from said second end of said second member is selected from the group including; hysteresis, additional material included with said body, a spring disposed between said first portion and said second portion, and a molded insert disposed between said first portion and said second portion.

9. The nail clipper of claim 2 including a safety bumper that affects an amount of material that is removed from a fingernail or toenail during a cutting of said fingernail or toenail.

10. The nail clipper of claim 9 wherein said safety bumper includes a protrusion that extends forward of either said cutting edge of said first blade or said cutting edge of said second blade.

11. The nail clipper of claim 10 wherein said protrusion includes a curvature that corresponds, in general, with a curvature of a fleshy part of a finger or toe that is disposed under said fingernail or under said toenail, respectively.

12. The nail clipper of claim 11 wherein said curvature of said safety bumper is formed into said first blade or into said second blade or into said first blade and into said second blade.

13. The nail clipper of claim 9 wherein said safety bumper is disposed around said first blade or disposed around said second blade or disposed around said first blade and said second blade.

14. The nail clipper of claim 9 wherein said safety bumper is adhered to a front surface of said first blade or said second blade or adhered to a portion of said body proximate said first blade or proximate said second blade.

15. The nail clipper of claim 4 wherein said means for urging said cutting edge of said first blade toward said cutting edge of said second blade includes a center rod, and wherein a portion of said lever applies said second force to said center rod, and wherein a lower portion of said center rod applies said second force to said bottom planar surface of said second portion when said lever is urged in said predetermined direction sufficient to urge said first blade and said second blade of said nail clipper away from said open position toward said closed position.

16. The nail clipper of claim 2 wherein said second force that is applied to said second blade urges said second blade toward said first blade.

17. An improvement to a nail clipper for cutting a portion of a toenail or a portion of a fingernail having a first blade and a second blade, wherein said first blade includes a first cutting edge and said second blade includes a second cutting edge, and wherein said nail clipper includes an open position in which said first cutting edge is disposed away from said second cutting edge and wherein said first cutting edge is parallel with respect to said second cutting edge when said nail clipper is disposed in said open position, and wherein said nail clipper includes a closed position in which said first cutting edge is disposed closer to said second cutting edge in said closed position than in said open position, and wherein said first cutting edge is parallel with respect to said second cutting edge when said nail clipper is disposed in said closed position, and wherein said nail clipper includes a body, and wherein the improvement comprises:

said body is formed primarily of a plastic or a non-metallic material and wherein said first and said second blades are formed for a different material than said body is primarily formed of, and wherein a portion of said first blade extends over at least some of an upper surface of said first end of said first portion; and wherein during a cutting of said toenail or said fingernail a force is applied to a surface of said first blade sufficient to urge said first blade toward said second blade, wherein as said first blade is urged toward said second blade, said first blade urges said first end of said first portion toward said second end of said second portion.

18. The improvement of claim 17 including a lever cooperatively attached to said nail clipper, wherein said lever applies a portion of said force to an upper surface of said first blade.

19. The improvement of claim 17 including a lever and a center rod, wherein said lever is cooperatively attached to said center rod, wherein said lever applies a portion of said force to said center rod, and wherein said center rod applies said portion of said force to a bottom surface of said second blade.

* * * * *